US007518523B2

(12) United States Patent
Yuan et al.

(10) Patent No.: US 7,518,523 B2
(45) Date of Patent: Apr. 14, 2009

(54) SYSTEM AND METHOD FOR CONTROLLING ACTUATOR POSITION

(75) Inventors: Qinghui Yuan, Maple Grove, MN (US); Christy W. Schottler, Brooklyn Park, MN (US); Jae Y. Lew, Shorewood, MN (US)

(73) Assignee: Eaton Corporation, Cleveland, OH (US)

( * ) Notice: Subject to any disclaimer, the term of this patent is extended or adjusted under 35 U.S.C. 154(b) by 286 days.

(21) Appl. No.: 11/650,267

(22) Filed: Jan. 5, 2007

(65) Prior Publication Data

US 2008/0163750 A1 Jul. 10, 2008

(51) Int. Cl.
*G08B 21/00* (2006.01)

(52) U.S. Cl. ..... 340/611

(58) Field of Classification Search ..... 340/611, 340/524, 606, 618; 91/392
See application file for complete search history.

(56) References Cited

U.S. PATENT DOCUMENTS 6,269,641 B1 * 8/2001 Dean ..... 60/567
6,575,264 B2 * 6/2003 Spadafora ..... 180/422
6,848,323 B2 2/2005 Krouth
7,114,430 B2 10/2006 Reedy et al.
7,406,982 B2 * 8/2008 Pfaff et al. ..... 137/596.17
2005/0211312 A1 9/2005 Pfaff et al.
2007/0101711 A1 * 5/2007 Debus ..... 60/476

OTHER PUBLICATIONS

PCT Search Report, PCT IB/2008/000002 search completed Oct. 14, 2008.

* cited by examiner

*Primary Examiner*—Phung Nguyen
(74) *Attorney, Agent, or Firm*—Sonu N. Weaver

(57) ABSTRACT

A method for estimating actuator position includes the steps of receiving fluid pressure data signals from a plurality of fluid pressure sensors (31), receiving spool position signals from at least one spool position sensor (33), and receiving actuator position data signals from at least one actuator position sensor (35). Corrected flow rates to and from an actuator (21) are determined with each corrected flow rate being based on fluid pressure data signals, the spool position signals, and an error-correction factor, wherein the error-correction factor is a function of the fluid pressure data signals and the spool position signals. An estimated actuator position is determined wherein the estimated position includes a kinematic component and a dynamic component. Adaptive gain factors are applied to calibrate the estimated actuator position to the actuator position data signals from the actuator position sensor.

21 Claims, 8 Drawing Sheets

SYSTEM AND METHOD FOR CONTROLLING ACTUATOR POSITION

BACKGROUND

1. Field of the Invention

The present invention relates to a system and method for controlling actuator position, and more particularly to an adaptive system and method that includes error correction.

2. Description of the Related Art

Fluid actuators are used in various hydraulic applications, including skid steer loaders, boom lifts, and mini excavators. The fluid actuators in these applications typically have a piston, which is encased by a cylinder, and a rod, which is attached to some accessory such as a bucket or a boom. In adjusting the position of the actuator, typically an operator of the application must manually actuate a joystick, which controls the position of the fluid actuator, and approximate the position of the actuator based on sight. If the operator's approximation is not correct, the operator must make minor adjustments to the position of the cylinder through the joystick. In some situations, the accurate positioning of the actuator could be critical, such as when positioning an actuator near electrical lines or near gas lines or water mains.

Some manufacturers have recommended using position sensors on the actuators. These position sensors typically require some type of marking on the rod so that the sensor can accurately sense the position of the actuator. While this would likely work in most applications, the sensors and the required markings on the rod significantly affect the cost of the actuator. As a result, most of the fluid actuators on these types of hydraulic applications do not use position sensors.

Information relevant to attempts to address the cost prohibitiveness of position sensing can be found in U.S. Pat. Nos. 6,848,323 and 7,114,430. However, each one of these references suffers from the disadvantage of not being precise enough to provide an accurate location of the actuator.

BRIEF SUMMARY

An actuator position control system comprises an actuator and at least one actuator position sensor mounted to the actuator. The actuator position control system further includes a flow control valve, which is in fluid communication with the actuator, that has at least one main stage spool, at least one spool position sensor, a supply port, a tank port, a first control port, and a second control port. A plurality of pressure sensors are included to monitor pressure of fluid at the supply port, the tank port, the first control port, and the second control port of the flow control valve. A controller is in electrical communication with the flow control valve wherein the controller is configured to receive a desired actuator position input, fluid pressure data signals from the plurality of fluid pressure sensors, spool position signals from the spool position sensor, and actuator position data signals from the actuator position sensor. The controller is further configured to determine the corrected fluid flow rates to and from the actuator based on the fluid pressure data signals, the spool position signals, and an error-correction factor, wherein the error-correction factor is a function of fluid pressure data signals and the spool position signals. The controller than calculates an estimated actuator position, wherein the estimated actuator position calculation includes a kinematic component, which is a function of the corrected fluid flow rates to and from the actuator, and a dynamic component, which is a function of pressure in a chamber of the actuator. Adaptive gain factors are applied to calibrate the estimated actuator position to the actuator position data signals from the actuator position sensor. The controller makes a comparison between the estimated actuator position and the desired actuator position input and then closes the main stage spool valve to prevent fluid communication to the actuator.

A method for estimating actuator position comprises the steps of receiving fluid pressure data signals from the plurality of fluid pressure sensors, spool position signals from the spool position sensor, and actuator position data signals from the actuator position sensor. Corrected fluid flow rates to and from an actuator are determined based on the fluid pressure data signals, the spool position signals, and an error-correction factor, wherein the error-correction factor is a function of the fluid pressure data signals and the spool position signals. The estimated actuator position is calculated, wherein the estimated actuator position calculation includes a kinematic component, which is a function of the corrected fluid flow rates to and from the actuator, and a dynamic component, which is a function of pressure of a chamber of the actuator. Adaptive gain factors are applied to calibrate the estimated actuator position to the actuator position data signals from the actuator position sensor.

BRIEF DESCRIPTION OF THE DRAWINGS

The accompanying drawings are included to provide a further understanding of the present invention and are incorporated in and constitute part of this specification. The drawings illustrate exemplary embodiments of the present invention and together with the description serve to further explain the principles of the invention, wherein.

DETAILED DESCRIPTION

Figure 1:
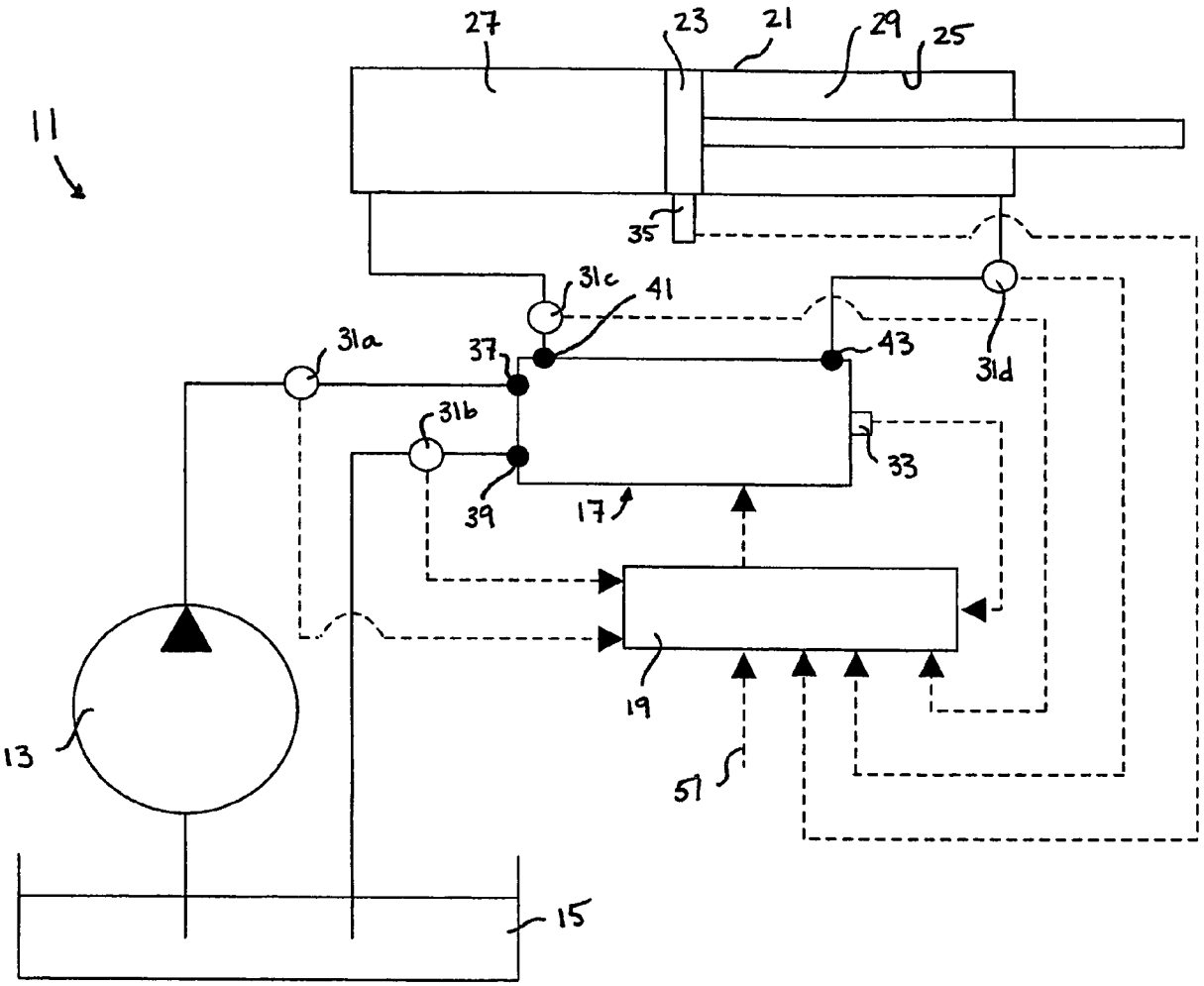
FIG. 1 is a schematic of an actuator position control system, which is made in accordance with the present invention.

Referring now to the drawings, which are not intended to limit the invention, FIG. 1 illustrates a schematic representation of an actuator position control system, generally designated 11. The actuator position control system 11 includes a fluid pump 13, shown herein as a fixed displacement pump, a system reservoir 15, a flow control valve, generally designated 17, a controller 19, and a linear actuator, or cylinder, 21. The cylinder 21 includes a piston 23, which separates an internal bore 25 of the cylinder 21 into a first chamber 27 and a second chamber 29. While the actuator position control system 11 is described with regard to the cylinder 21, it will be understood by those skilled in the art after reviewing the disclosure of the present invention that the scope of the present invention is not limited to linear actuators. The actuator position control system 11 and the methods described herein could also be used to determine the position of a rotary actuator. Therefore, the term "actuator" as used in the appended claims shall refer to both rotary and linear actuators.

The actuator position control system 11 also includes a plurality of fluid pressure sensors 31*a*, 31*b*, 31*c*, 31*d* that monitor the pressure of the fluid associated with the fluid pump 13, the system reservoir 15, the first chamber 27 of the cylinder 21, and the second chamber 29 of the cylinder 21, respectively. The actuator position control system 11 also includes at least one spool position sensor 33, which will be described in more detail subsequently, and at least one actuator position sensor 35. While the actuator position sensor 35 is shown in a center location of the cylinder 21, it will be understood by those skilled in the art after reviewing the disclosure of the present invention that the location of the actuator position sensor 35 could be anywhere along the cylinder 21. In addition, it will be understood by those skilled in the art after reviewing the disclosure of the present invention that multiple actuator position sensors 35 could be used in the actuator position control system 11. However, increasing the number of actuator position sensors 35 would likely increase the cost of the actuator position control system 11. In the subject embodiment, the actuator position sensor 35 is of a latch sensor type, which transmits a signal to the controller 19 when the piston 23 of the cylinder 21 is sensed by the actuator position sensor 35. However, as there are various types of actuator position sensors 35 that would be adequate, the scope of the present invention is not limited to actuator position sensors 35 of the latch sensor type. Data from these sensors 31, 33, 35 is transmitted to the controller 19.

Referring still to FIG. 1, the flow control valve 17 will now be described. In the subject embodiment, the flow control valve 17 includes a plurality of ports including a supply port 37, which is in fluid communication with the fluid pump 13 and the pressure sensor 31*a*, a tank port 39, which is in fluid communication with the system reservoir 15 and the pressure sensor 31*b*, a first control port 41, which is in fluid communication with the first chamber 27 of the cylinder 21 and the pressure sensor 31*c*, and a second control port 43, which is in fluid communication with the second chamber 29 of the cylinder 21 and the pressure sensor 31*d*. In the subject embodiment, when the flow control valve 17 allows fluid communication between the supply port 37 and the first control port 41 and between the tank port 39 and the second control port 43, pressurized fluid from the fluid pump 13 flows through the flow control valve 17 into the first chamber 27 of the cylinder 21, while fluid from the second chamber 29 flows to the system reservoir 15. This fluid communication results in the extension of the cylinder 21. In the alternative, when the flow control valve 17 allows fluid communication between the tank port 39 and the first control port 41, and between the supply port 37 and the second control port 43, pressurized fluid from the fluid pump 13 flows through the flow control valve 17 into the second chamber 29 of the cylinder 21, while fluid from the first chamber 27 flows to the system reservoir 15. This fluid communication results in the retraction of the cylinder 21.

Figure 2A:
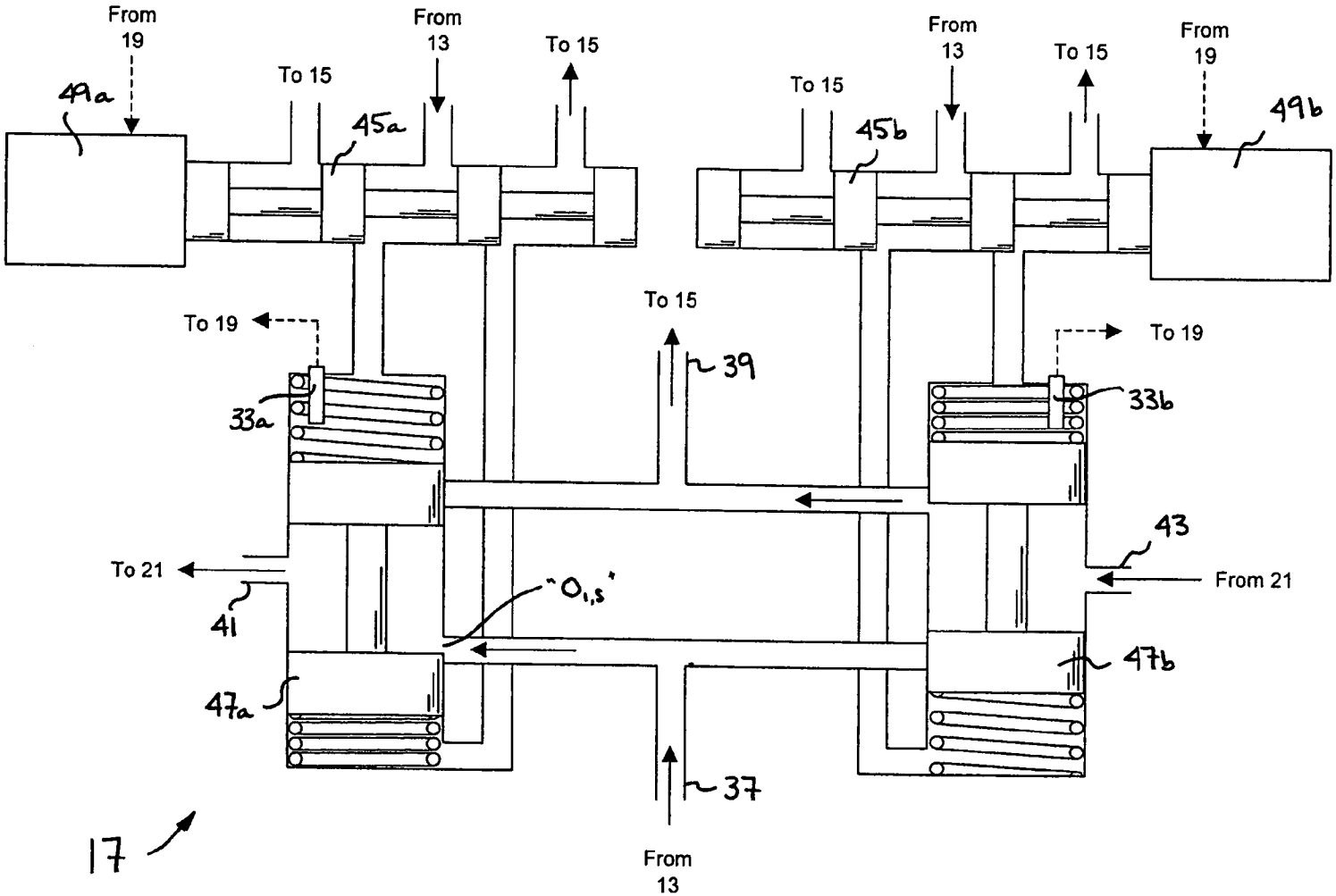
FIG. 2*a* is a schematic of a flow control valve in a first position, which is made in accordance with the present invention.
Figure 2B:
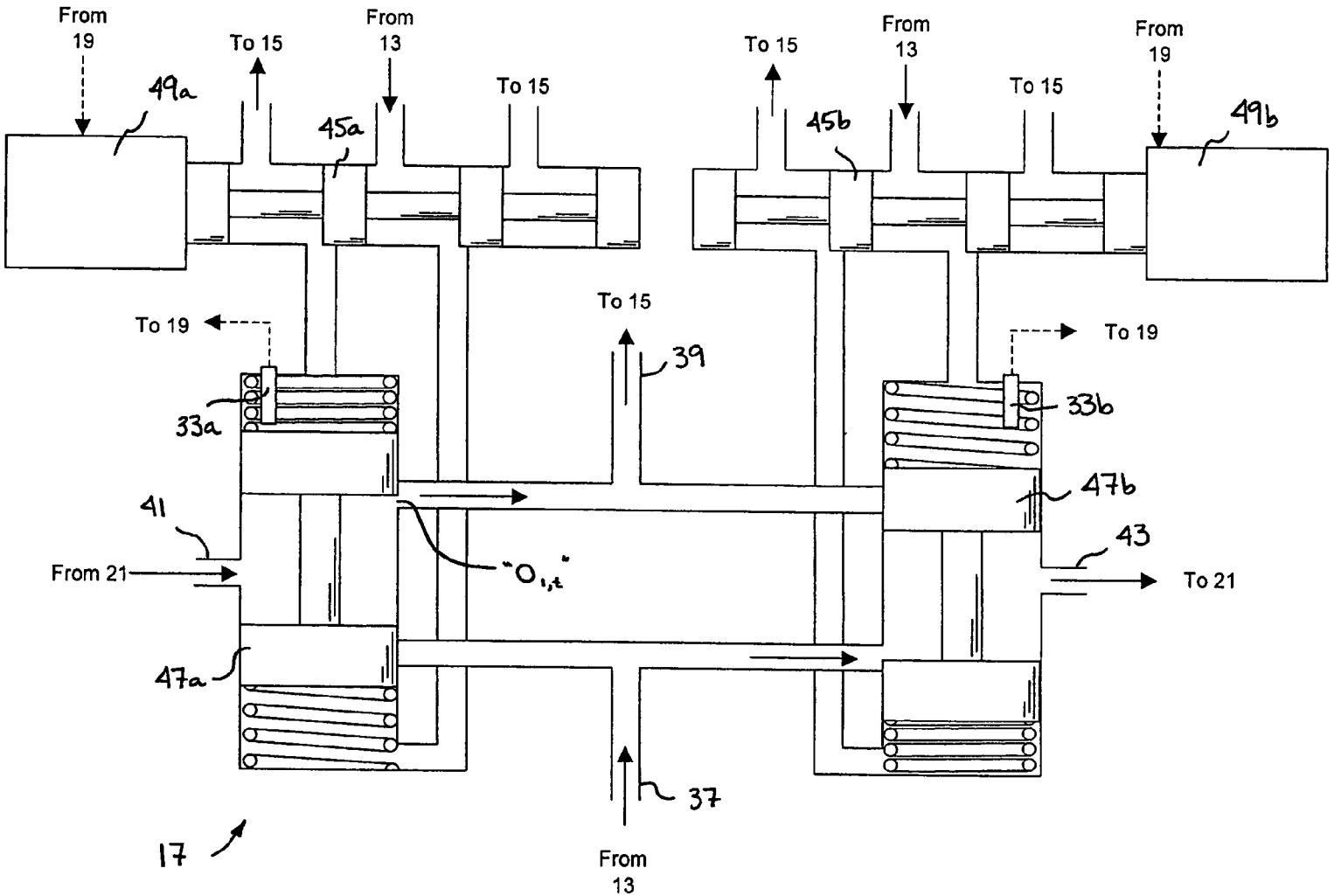
FIG. 2*b* is a schematic of a flow control valve in a second position, which is made in accordance with the present invention.

FIGS. 2*a* and 2*b* provide schematic representations of an exemplary embodiment of the flow control valve 17. In addition to the plurality of ports 37, 39, 41, 43 described above, the flow control valve 17 further includes two pilot stage spools 45*a*, 45*b* and two main stage spools 47*a*, 47*b* associated with the cylinder 21. It shall be understood by those skilled in the art, however, after reviewing the disclosure of the present invention that while the subject embodiment has shown the flow control valve 17 schematically in FIGS. 2*a* and 2*b* as having two pilot stage spools 45*a*, 45*b* and two main stage spools 47*a*, 47*b* in association with a single cylinder 21, it is also within the scope of the present invention to have only one pilot stage spool 45 and one main stage spool 47 in association with a single cylinder 21, or any combination thereof.

The positions of the pilot stage spools 45*a*, 45*b* are controlled by actuators 49*a*, 49*b*, respectively. While it is preferred that actuators 49*a*, 49*b* are of the electromagnetic type, such as voice coils, it will be understood by those skilled in the art after reviewing the disclosure of the present invention that actuators 49*a*, 49*b* could be of any type that is capable of providing linear motion to the pilot stage spools 45*a*, 45*b*. The positions of the pilot stage spools 45*a*, 45*b* control the positions of the main stage spools 47*a*, 47*b*, respectively, by regulating the fluid pressure that acts on either end of the main stage spools 47*a*, 47*b*. The positions of the main stage spools 47*a*, 47*b*, on the other hand, control the fluid flow rate to the cylinder 21. In the subject embodiment, the spool position sensors 33*a*, 33*b* measures the positions of the main stage spools 47*a*, 47*b*, respectively, and transmit position data to the controller 19 for use by the controller 19 in determining an estimated actuator position, which will be described in greater detail subsequently. While many different types of spool position sensors 33*a*, 33*b* would be adequate for use in this system, Linear Variable Differential Transformers (LVDTs) are preferred. In FIG. 2*a*, the flow control valve 17 is in a first position in which the actuator 49*a* positions the pilot stage spool 45*a* such that the main stage spool 47*a* provides fluid communication between the supply port 37 and the first control port 41, while the actuator 49*b* positions the pilot stage spool 45*b* such that the main stage spool 47*b* provides fluid communication between the tank port 39 and the second control port 43. In the subject embodiment, this first position would result in the extension of the cylinder 21. In FIG. 2*b*, the flow control valve 17 is in a second position in which the actuator 49*a* positions the pilot stage spool 45*a* such that the main stage spool 47*a* provides fluid communication between the tank port 39 and the first control port 41, while the actuator 49*b* positions the pilot stage spool 45*b* such that the main stage spool 47*b* provides fluid communication between the supply port 37 and the second control port 43. In the subject embodiment, this second position would result in the retraction of the cylinder 21.

Referring again to FIG. 1, the pressure sensors 31 are shown external to the flow control valve 17. However, the scope of the present invention is not limited to the pressure sensors 31 being external to the flow control valve 17. In the preferred embodiment, the pressure sensors 31 would be integrated in the flow control valve 17. Such an arrangement is described in UK Pat. No. GB2328524 and is incorporated herein by reference. In addition, the controller 19 is also shown schematically in FIG. 1 as being external to the flow control valve 17. However, the scope of the present invention is not limited to the controller 19 being external to the flow control valve 17. In the preferred embodiment, the controller 19 would also be integrated in the flow control valve 17.

Figure 3:
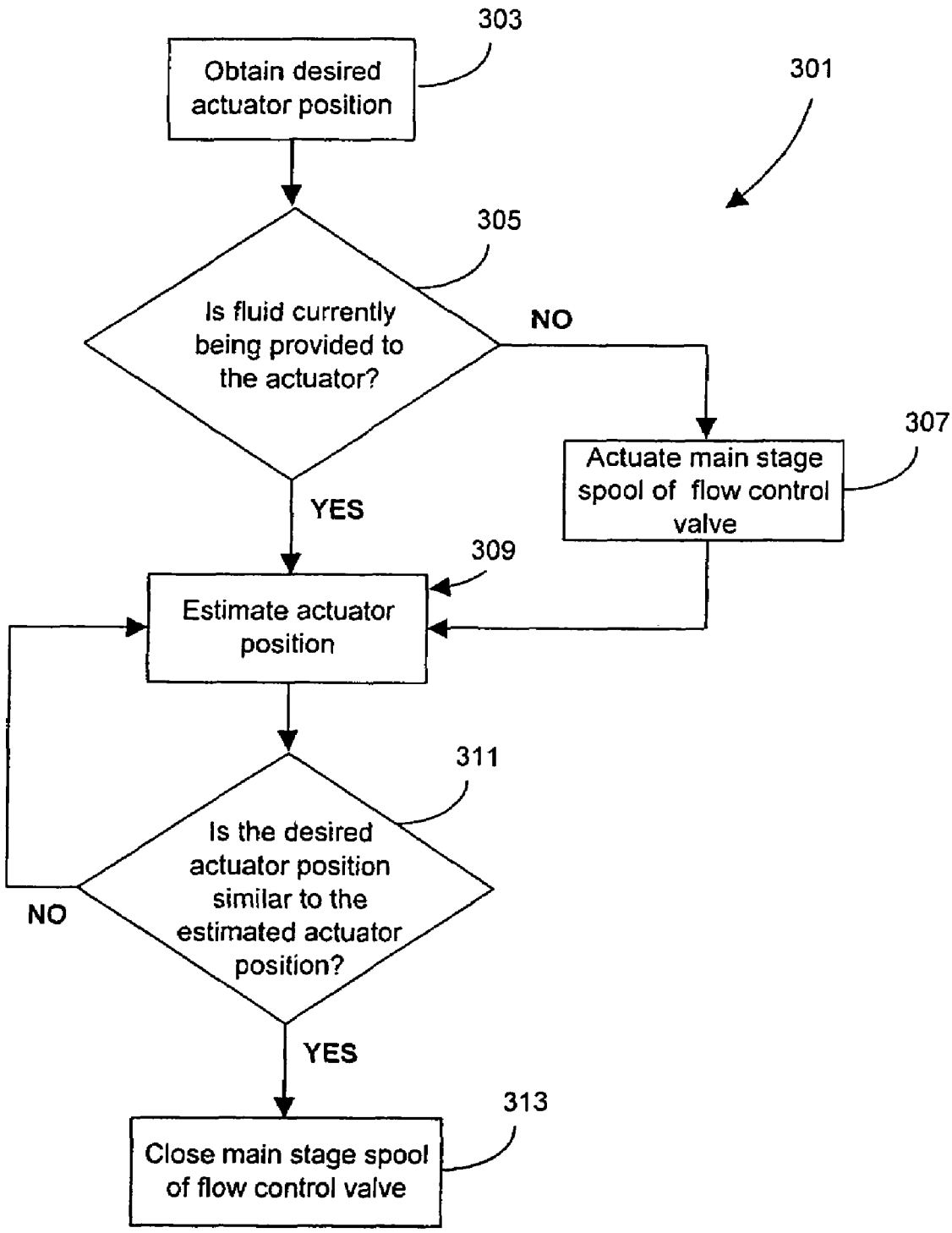
FIG. 3 is a block diagram of a method for controlling actuator position in accordance with the present invention.

Referring now primarily to FIG. 3 with references made to elements introduced in FIGS. 1 and 2, a method 301 for controlling an actuator will be described. In step 303 of the method 301, a desired actuator position 51 (shown schematically in FIG. 1) is obtained by the controller 19. The desired actuator position can be inputted in a variety of ways, including but not limited to a joystick used by an operator or through a keyboard. In step 305, the controller 19 determines whether fluid is currently being provided to the cylinder 21. This determination can be made by the controller from information received from the spool position sensors 33*a*, 33*b*. If there is no fluid being provided to the cylinder 21, the controller 19 sends a signal to the actuators 49*a*, 49*b* to actuate the pilot stage spools 45*a*, 45*b*, which in turn actuate the main stage spools 47*a*, 47*b*, in step 307. This allows for fluid communication to and from the appropriate chambers 27, 29 of the cylinder 21. If fluid is currently being communicated to and from the appropriate chambers 27, 29 of the cylinder 21, the method 301 proceeds to the next step. An estimated actuator position is then determined using a method 309 that will be described in greater detail subsequently. In step 311, a comparison is made between the desired actuator position and the estimated actuator position determined by the method 309. If these actuator positions are similar, a signal is communicated to the actuators 49*a*, 49*b* that results in the closing of the main stage spool valves 47*a*, 47*b*, which prevents further fluid communication to the cylinder 21. It will be understood by those skilled in the art after reviewing the disclosure of the present invention that the step 311 could also include the step of communicating a signal to the actuators 49*a*, 49*b* to begin closing the main stage spool valves 47*a*, 47*b* as the desired actuator position and the estimated actuator position get closer in value. This step would avoid an abrupt stop in the movement of the cylinder 21. If, however, the estimated actuator position and the desired position are not similar, the main stage spool valves 47*a*, 47*b* are left in position and the actuator position is again estimated using method 309.

Figure 4:
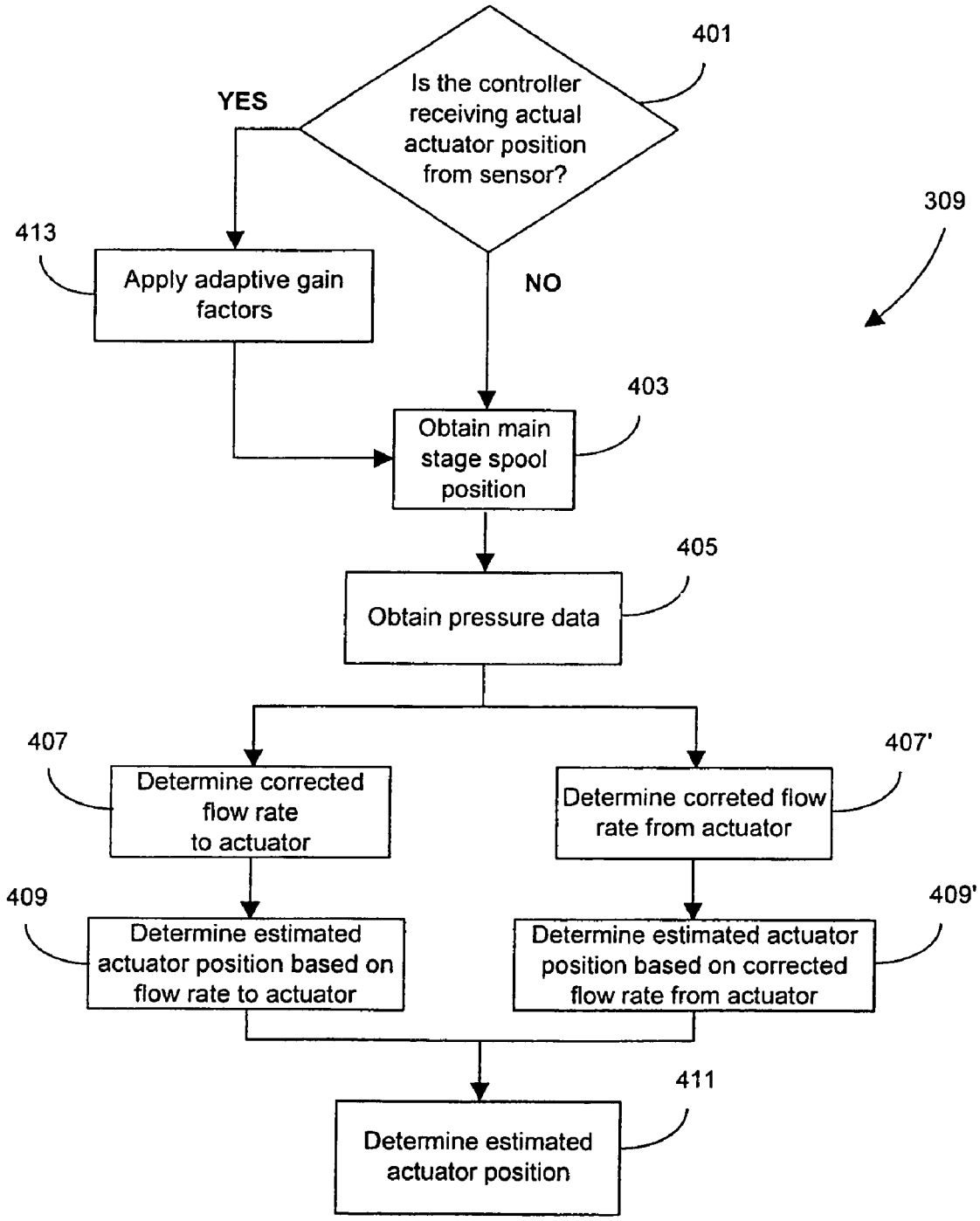
FIG. 4 is a block diagram of a method for estimating the position of an actuator in accordance with the present invention

Referring now to FIG. 4, the method 309, which estimates actuator position, will now be described in greater detail. In step 401, a determination is made as to whether the controller 19 is receiving actual actuator position data from the actuator position sensor 35. If no actual actuator position data has been received, a position, $X_{Sp1}$, of the main stage spool 47*a*, which is associated with the first chamber 27 of the cylinder 21 and a position, $X_{Sp2}$, of the main stage spool 47*b*, which is associated with the second chamber 29 of the cylinder 21, is obtained in step 403 from the spool position sensors 33*a*, 33*b*. In step 405, fluid pressure data corresponding to the pressure of the fluid at the fluid pump 13, referred to hereinafter as $P_S$, the system reservoir 15, referred to hereinafter as $P_t$, the first chamber 27 of the cylinder 21, referred to hereinafter as $P_1$, and the second chamber 29 of the cylinder 21, referred to hereinafter as $P_2$, is obtained from the fluid pressure sensors 31*a*, 31*b*, 31*c*, 31*d*. It will be understood by those skilled in the art that the order of steps 401, 403, and 405 are not critical to the scope of the present invention.

In steps 407 and 407', corrected flow rates, $Q_{1,C}$ and $Q_{2,C}$, are calculated with regard to fluid flowing to and from the cylinder 21. The corrected flow rate is a flow rate calculation that reduces or "corrects" implicit errors in a theoretical flow rate equation by multiplying the theoretical flow rate by an error-correction factor. For ease of description, this calculation will be described with regard to the first chamber 27 of the cylinder 21 only. It will be understood by those skilled in the art after reviewing the disclosure of the present invention, however, that the calculation of the corrected flow rate, $Q_{2,C}$, associated with the second chamber 29 of the cylinder 21 is similar to the calculation of the corrected flow rate, $Q_{1,C}$, which is described below. The corrected flow rate equation, $Q_{1,C}$, associated with the first chamber 27 of the cylinder 21 is:

$$Q_{1,C}=K_1 \cdot Q_1,$$

where $Q_1$ is the estimated flow rate of fluid to or from the first chamber 27 of the cylinder 21, and $K_1$ is the error-correction factor. A more detailed description of these terms is provided immediately below.

The estimated flow rate, $Q_1$, is a theoretical nonlinear function based on variables $P_S$, $P_t$, $P_1$, and $X_{Sp1}$. While there are a variety of equations that could be used to calculate the estimated flow rate, $Q_1$, two exemplary equations are provided below. The first equation would be used if the main stage spool 47*a* of the flow control valve 17 was positioned such that the first control port 41 was in fluid communication with the supply port 37. In other words, the following equation would be used when fluid is flowing from the fluid pump 13 to the first chamber 27 of the cylinder 21, thereby resulting in the extension of cylinder 21. It should be noted, however, that the following equation would also be used when the pressure of the fluid in the first chamber 27 is greater than the pressure of the fluid being output from the fluid pump 13, even though this situation would create a backflow of fluid from the first chamber 27 to the fluid pump 13 which would result in the retraction of the cylinder 21. In both of these scenarios, $Q_1$ may be calculated using the following equation:

$$Q_1 = C_d \cdot W \cdot X_{Sp1} \cdot sgn(P_S - P_1) \cdot \sqrt{\frac{2 \cdot |P_S - P_1|}{\rho}},$$

where $C_d$ is a discharge coefficient, $X_{Sp1}$ is the position of the main stage spool 47*a*, W is a differential of orifice area, which is a function of the main stage spool position, over a differential of the main stage spool position, $dA(X_{sp1})/dX_{sp1}$, (the orifice is shown in FIG. 2*a* by reference letter "$O_{1,S}$"), and ρ is the density of the fluid.

The second equation would be used if the main stage spool 47*a* of the flow control valve 17 was positioned such that the first control port 41 was in fluid communication with the tank port 31. In other words, the following equation would be used when fluid is flowing from the first chamber 27 of the cylinder 21 to the system reservoir 15, thereby resulting in the retraction of the cylinder 21. In this scenario, $Q_1$ may be calculated using the following equation:

$$Q_1 = C_d \cdot W \cdot X_{Sp1} \cdot sgn(P_1 - P_t) \cdot \sqrt{\frac{2 \cdot |P_1 - P_t|}{\rho}},$$

where $C_d$ is a discharge coefficient, $X_{Sp1}$ is the position of the main stage spool 47*a*, W is a differential of orifice area, which is a function of the main stage spool position, over a differential of the main stage spool position, $dA(X_{Sp1})/dX_{Sp1}$, (the orifice is shown in FIG. 2*b* by reference letter "$O_{1,t}$"), and ρ is the density of the fluid.

As stated above, the estimated flow rate, $Q_1$, is a theoretical equation. Due to multiple factors, including but not limited to fluid viscosity, fluid type, fluid temperature, etc., the estimated flow rate, $Q_1$, does not always correlate to a flow rate that is experimentally measured. Therefore, an error-correction factor, $K_1$, is used to reduce error associated with the theoretical equation. The error-correction factor, $K_1$, is defined by the following nonlinear function: $K_1=f(P_s, P_1, P_t, X_{Sp1})$. As this function may be determined experimentally, a variety of equations could be used to correlate the independent variables to the correction factor. An example of such an equation is provided below:

$$K_1 = c_0 + c_1 \cdot X_{Sp1} + c_2 \cdot \sqrt{P_S - P_1} + c_3 \cdot X_{Sp1}^2 + c_4 \cdot (P_S - P_1),$$

where $c_0$, $c_1$, $c_3$, and $c_4$ are experimentally determined coefficients.

It will be understood by those skilled in the art after reviewing the disclosure of the present invention that the scope of the present invention does not require that these calculations be performed during the operation of the actuator position control system 11. Rather, the values of the corrected flow rates, $Q_{1,C}$ and $Q_{2,C}$, could be contained in a look-up table, which are retrievable based on the values of input parameters $P_S$, $P_t$, $P_1$, $P_2$, $X_{Sp1}$ and $X_{Sp2}$.

In steps 409 and 409', estimated actuator positions, $X_{1,Est}$ and $X_{2,ESt}$, of the cylinder 21 are determined based on the corrected flow rates, $Q_{1,C}$ and $Q_{2,C}$, respectively. For ease of description, this determination will be described with regard to the corrected flow rate, $Q_{1,C}$, of the first chamber 27 of the cylinder 21 only. It will be understood by those skilled in the art after reviewing the disclosure of the present invention, however, that the determination of the estimated actuator position, $X_{2,ESt}$, with regard to the corrected flow rate, $Q_{2,C}$, of the second chamber 29 of the cylinder 21 is similar. In the subject embodiment, the position of the cylinder 21 with regard to the corrected flow rate, $Q_{1,C}$, of the first chamber 27 is calculated by integrating an equation for the velocity of the piston 23, $X^*_{1,Est}$, over a period of time, where the equation for the velocity of the piston 23, $X^*_{1,Est}$, has a dynamic component and a kinematic component. An example of such an equation is provided below:

$$X^*_{1,Est} = \left[\frac{1}{\beta_{Est} A}(-A\eta_1 X_{1,Est} - \eta_1 V_1)\right] + \left[\frac{1}{A} Q_{1,C}\right],$$

where $\beta_{Est}$ is the estimated bulk modulus of the fluid; A is the area of the piston 23 that is subjected to pressurized fluid; $V_1$ is the volume of the first chamber 27 of the cylinder 21 when the piston 23 is fully retracted; $X_{1,Est}$ is the estimated actuator position; $\eta_1$ represents the variation in fluid pressure, $P_1$, in the first chamber 27 of the cylinder 21 over a given sample time that has been filtered to eliminate noise; and $Q_{1,C}$ is the corrected flow rate. The dynamic component of the above velocity equation is provided in the first set of square brackets and in the above equation is a function of the fluid pressure, $P_1$, in the first chamber 27 of the cylinder 21. The kinematic component of the above velocity equation is provide in the second set of square brackets and is based on the corrected flow rate, $Q_{1,C}$, divided by the area of the piston 23 that is subjected to pressurized fluid.

In step 411, the estimated positions, $X_{1,Est}$ and $X_{2,ESt}$, of the cylinder 21 are compared. If those positions are different from each other, a determination of the estimated actuator position, $X_{Est}$, is made. This determination could be made by taking the arithmetic mean of the positions, $X_{1,Est}$, and $X_{2,Est}$, or by using some other weighted average function.

Figure 5:
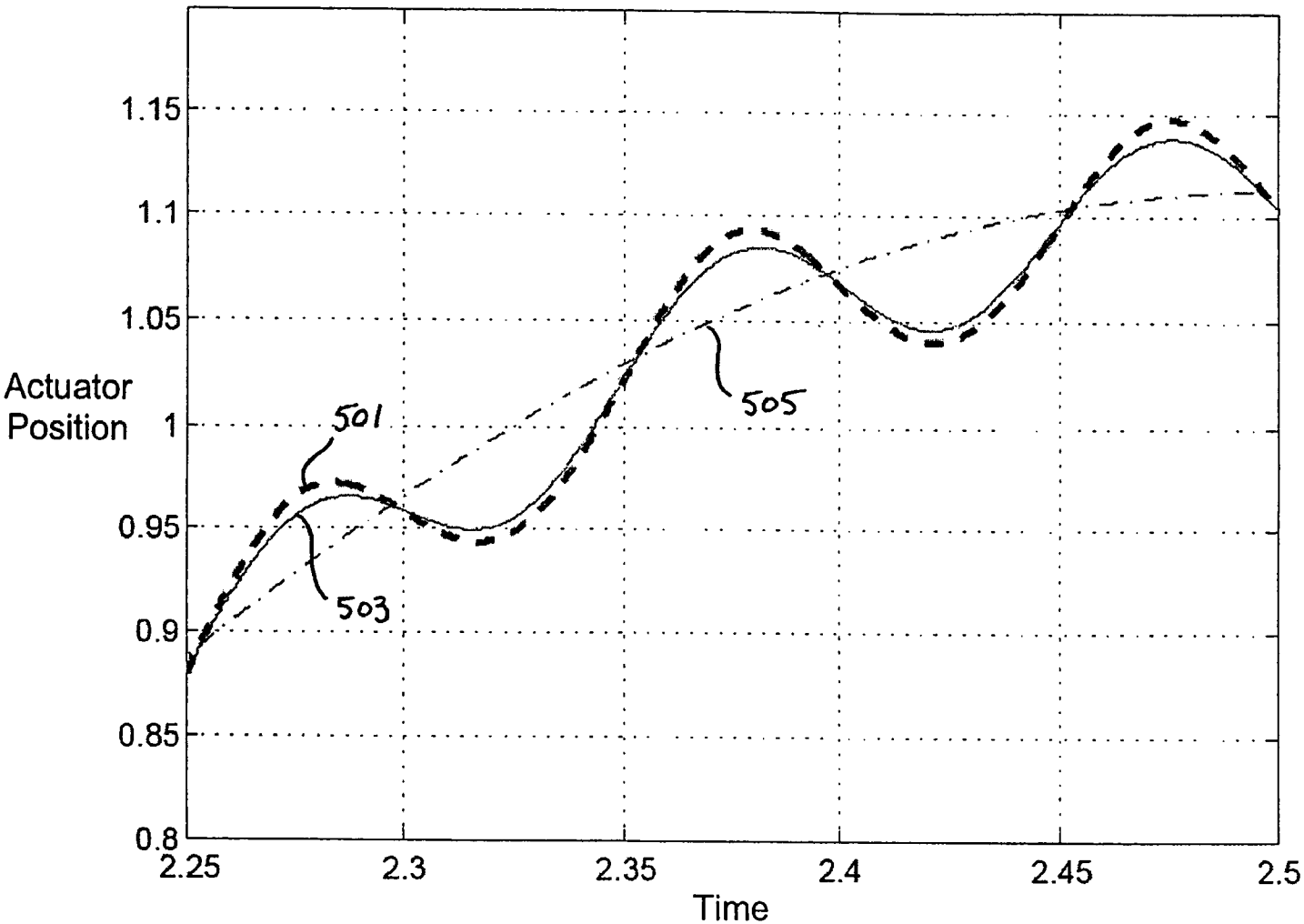
FIG. 5 is a plot of actuator position versus time.

Referring now to FIG. 5, the importance of including both the dynamic and kinematic components in the determination of the estimated actuator positions, $X_{1,Est}$, and $X_{2,Est}$, is shown. Plots of actual actuator position 501, estimated actuator position 503, and kinematic actuator position 505, which is based solely on the kinematic component of the velocity equation, are provided in FIG. 5. In this plot, the piston 23 of the cylinder 21 is oscillating while expanding. The oscillation could be caused an external condition, such as an outside force exerted against the cylinder 21. The kinematic actuator position 505 is only able to capture the overall movement of the piston 23 and therefore does not capture the oscillations of the piston 23. In the subject embodiment, and by way of example only, this results in the kinematic actuator position having an error of around 5%, although this error could be much larger depending on the outside force acting against the cylinder 21. The estimated actuator position 503, which includes the dynamic component and the kinematic component described above, on the other hand, closely approximates the actual actuator position 501, including the oscillations of the piston 23 due to the outside force acting against the cylinder 21.

Referring again to FIG. 4, the adaptivity of the method 309, which estimates the actuator position, will now be described. If the controller 19 has received the actual actuator position, $X_{Act}$, from the actuator position sensor 35 in step 401 and the estimated actuator positions, $X_{1,Est}$, and $X_{2,Est}$, with respect to the first 27 and the second 29 chambers of the cylinder 21, respectively, are different than the actual actuator position, $X_{Act}$, adaptive gain factors, $\delta_1$ and $\delta_2$ are determined in step 413 to calibrate the estimated actuator positions to the actual actuator position. Thus, the adaptive gain factors, $\delta_1$ and $\delta_2$, are based on the actuator position errors, $X_{1,Err}$ and $X_{2,Err}$, respectively, where $X_{1,Err}=X_{1,EST}-X_{Act}$ and $X_{2,Err}=X_{2,Est}-X_{Act}$. The adaptive gain factors, $\delta_1$ and $\delta_2$, are then applied as an adjustment to the determination of the corrected flow rates, $Q_{1,C}$ and $Q_{2,C}$. This adjustment to the corrected flow rates, $Q_{1,C}$ and $Q_{2,C}$, can be accomplished by multiplying the error-correction factors, $K_1$ and $K_2$, by the adaptive gain factors, $\delta_1$ and $\delta_2$, respectively.

A theoretical equation that represents the actuator position error, $X_{1,Err}$, will be briefly described in order to demonstrate how that adjustment to the error-correction flow rates are made. While only the actuator position error, $X_{1,Err}$, with respect to the first chamber 27 of the cylinder 21 will be described, it will be understood by those skilled in the art after reviewing the disclosure of the present invention that the adjustment based on the actuator position error, $X_{2,Err}$, with respect to the second chamber 29 of the cylinder 21 is similar. The theoretical equation for the actuator position error, $X_{1,Err}$, is given below:

$$X_{1,Err}(t+1) = \left[\int^{t+1}\left(\frac{-\eta_1}{\beta_{Est}} X_{1,Err} + \frac{1}{\beta_{Err}}\left(-\eta_1 X_{1,Est} - \eta_1 V_1 \frac{1}{A}\right)\right) dt\right] + \left[\int^{t+1} -\frac{1}{A} Q_{1,Err}\, dt\right],$$

where $X_{1,Err}(t+1)$ is the actuator position error at sample time t+1, $\beta_{Est}$ is the estimated bulk modulus of the fluid; $\beta_{Err}$ is the error associated with the bulk modulus of the fluid which may be calculated using the following equation:

$$\frac{1}{\beta_{Err}} = \frac{1}{\beta_{Est}} - \frac{1}{\beta_{Act}};$$

A is the area of the piston 23 that is subjected to pressurized fluid; $V_1$ is the volume of the first chamber 27 of the cylinder 21 when the piston 23 is fully retracted; $X_{1,Est}$ is an estimate of the actuator position; $\eta_1$ represents the variation in fluid pressure, $P_1$, in the first chamber 27 of the cylinder 21 over a given sample time that has been filtered to eliminate noise; and $Q_{1,Err}$ is the flow rate error which is calculated using the following equation: $Q_{1,C}-Q_{1,ACT}$, where $Q_{1,ACT}$ is the actual flow rate to the first chamber 27.

It should be noted that all of the terms in the integral in the first set of square brackets in the theoretical equation for the actuator position error are multiplied by $\eta_1$, which represents the filtered variation in fluid pressure in the first chamber 27 of the cylinder 21. This term $\eta_1$ could be positive or negative depending on the fluid pressure variations in the first chamber 27 over a given sample time. As these fluid pressure variations are largely the result of external conditions, such as an outside force exerted against the cylinder 21, $\eta_1$ is a term that is somewhat unpredictable. As a result of this unpredictability, it would be difficult to correlate an adjustment to one of the terms in the integral in the first set of square brackets with the actuator position error, $X_{1,Err}$, with respect to the first chamber 27. However, an adjustment to one of the terms in the integral in the second set of brackets in the above equation could be more readily correlated to the actuator position error, $X_{1,Err}$, due to the predictability of those terms. An example will be briefly explained to demonstrate how the error-correction factor, $K_1$, could be correlated to the actuator position error, $X_{1,Err}$. The integral in the second set of brackets can be simplified as:

$$\int^{t+1} \frac{Q_{1,ACT} - K_1 \cdot Q_1}{A}\, dt.$$

Therefore, assuming that the actuator position error, $X_{1,Err}$, is governed by this integral, if the difference between the estimated actuator position, $X_{1,Est}$, and the actual actuator position, $X_{Act}$, is positive, the error-correction factor, $K_1$, should be increased. On the other hand, if the difference between the estimated actuator position, $X_{1,Est}$, and the actual actuator position, $X_{Act}$, is negative, the error-correction factor, $K_1$, should be decreased. Thus, if the main stage spool 47*a* of the flow control valve 17 is positioned such that the first control port 41 is in fluid communication with the supply port 37 and the actuator position error, $X_{1,Err}$, is greater than zero, then the correction factor, $K_1$, is multiplied by an adaptive gain factor, $\delta_1$, where $\delta_1>1$. In this example, the equation for the corrected flow rate, $Q_{1,c}$, would be $Q_{1,c}=\delta_1 \cdot K_1 \cdot Q_1$. If the main stage spool 47*a* of the flow control valve 17 is positioned such that the first control port 41 is in fluid communication with the supply port 37 but the actuator position error is less than or equal to zero, then the error-correction factor, $K_1$, is multiplied by an adaptive gain factor $$\frac{1}{\delta_1},$$

where $\delta_1>1$. In this example, the equation for the corrected flow rate, $Q_{1,c}$, would be $$Q_{1,c} = \frac{1}{\delta_1} \cdot K_1 \cdot Q_1.$$

If, however, the main stage spool 47*a* of the flow control valve 17 is positioned such that the first control port 41 is in fluid communication with the tank port 39 and the actuator position error, $X_{1,Err}$, is greater than zero, then the correction factor, $K_1$, is multiplied by an adaptive gain factor, $$\frac{1}{\delta_1},$$

where $\delta_1>1$. In this example, the equation for the corrected flow rate, $Q_{1,c}$, would be $$Q_{1,c} = \frac{1}{\delta_1} \cdot K_1 \cdot Q_1.$$

If the main stage spool 47*a* of the flow control valve 17 is positioned such that the first control port 41 is in fluid communication with the tank port 39 but the actuator position error, $X_{1,Err}$, is less than or equal to zero, then the error-correction factor, $K_1$, is multiplied by an adaptive gain factor $\delta_1$, where $\delta_1>1$. In this example, the equation for the corrected flow rate, $Q_{1,c}$, would be $Q_{1,c}=\delta_1 \cdot K_1 \cdot Q_1$.

In the preferred embodiment of the present invention, the adaptive gain factor, $\delta_1$, is a function of the actual position error, $X_{1,Err}$. The larger the actuator position error, the more aggressive the change to the error-correction factor, $K_1$, will be. However, it will be understood by those skilled in the art after reviewing the disclosure of the present invention that the adaptive gain factor, $\delta_1$, could be any real value. In order to prevent an overly aggressive change to the error-correction factor, $K_1$, in the preferred embodiment, the adaptive gain factor, $\delta$, would be less than or equal to two.

Figure 6:
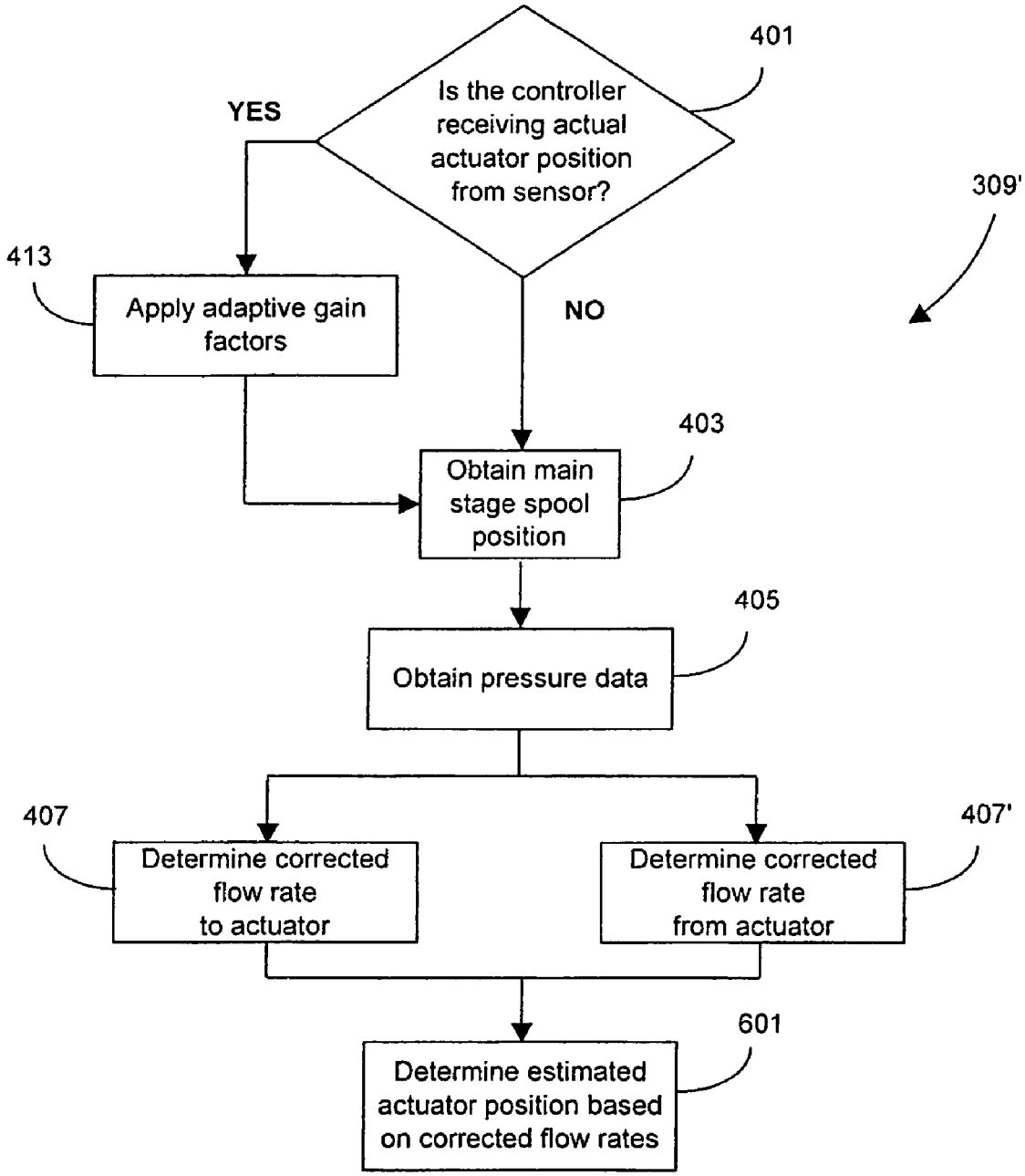
FIG. 6 is a block diagram of an alternate method for estimating the position of an actuator in accordance with the present invention.

Referring now to FIG. 6, an alternate method 309' used by the controller to determine the estimated position of the cylinder 21 will be described. In this alternative method 309', method steps that are the same or similar as those in the method 309 will have the same reference number and will not be further described. Additional method steps, however, shall have reference numerals in excess of "600" and shall be described in detail.

Similar to the method 309, in step 401 of the alternative method 309', a determination is made as to whether the controller 19 is receiving actual actuator position data from the actuator position sensor 35. If no actual actuator position data has been received, positions, $X_{Sp1}$ and $X_{Sp2}$, of the main stage spools 47*a*, 47*b* which are associated with the first and second chambers 27, 29, respectively, of the cylinder 21, are obtained in step 403 from the spool position sensors 33*a*, 33*b*. In step 405, fluid pressure data $P_S$, $P_r$, $P_1$, and $P_2$ is obtained from the fluid pressure sensors 31*a*, 31*b*, 31*c*, 31*d*, respectively. It will be understood by those skilled in the art that the order of steps 401, 403, and 405 are not critical to the scope of the present invention.

In steps 407 and 407', corrected flow rates, $Q_{1,C}$ and $Q_{2,C}$, are determined with regard to fluid flowing to and from the cylinder 21, where the corrected flow rate determinations would be similar to those described in method 309. In step 601, a corrected flow rate, $Q_C$, is determined based on the corrected flow rates, $Q_{1,C}$ and $Q_{2,C}$. If the corrected flow rates, $Q_{1,C}$ and $Q_{2,C}$, are equal, then the corrected flow rate, $Q_c$, could equal $Q_{1,C}$ and $Q_{2,C}$. If, however, the corrected flow rates, $Q_{1,C}$ and $Q_{2,C}$, are different from each other, a determination of the corrected flow rate, $Q_C$, is made. This determination could be made by taking the arithmetic mean of the corrected flow rates, $Q_{1,C}$ and $Q_{2,C}$, or by using some other weighted average function. Following this determination, the estimated actuator position, $X_{Est}$, is calculated based on the corrected flow rate, $Q_C$, in a calculation that is similar to that described with regard to method 309. The adaptivity of the method 309' in step 413 is similar to that described in step 413 in method 309.

An advantage to using the methods 309 and 309' to determine actuator position is that the methods 309 and 309' incorporate three ways in which errors associated with the theoretical calculations are minimized. The first way involves the use of the error-correction factors, $K_1$ and $K_2$. These error-correction factors, $K_1$ and $K_2$, minimize errors associated with the calculation of the theoretical flow rates, $Q_1$ and $Q_2$, by correlating the theoretical flow rates, $Q_1$ and $Q_2$, to experimentally measured flow rates. The second way involves the use of the adaptive gain factors, $\delta_1$ and $\delta_2$, which are multiplied to the error-correction factors, $K_1$ and $K_2$, respectively. These adaptive gain factors minimize errors between the estimated actuator position, $X_{Est}$, and the actual actuator position, $X_{Act}$. The third way in which errors associated with the theoretical calculations are minimized involves the use of two corrected flow rates, $Q_{1,C}$ and $Q_{2,C}$, in the determination of the estimated actuator position, $X_{Est}$. By using two corrected flow rates, $Q_{1,C}$ and $Q_{2,C}$, a discrepancy between the two corrected flow rates would be minimized by using some weighted mean function. This in turn would potentially reduce an error in the determination of the estimated actuator position.

Figure 7:
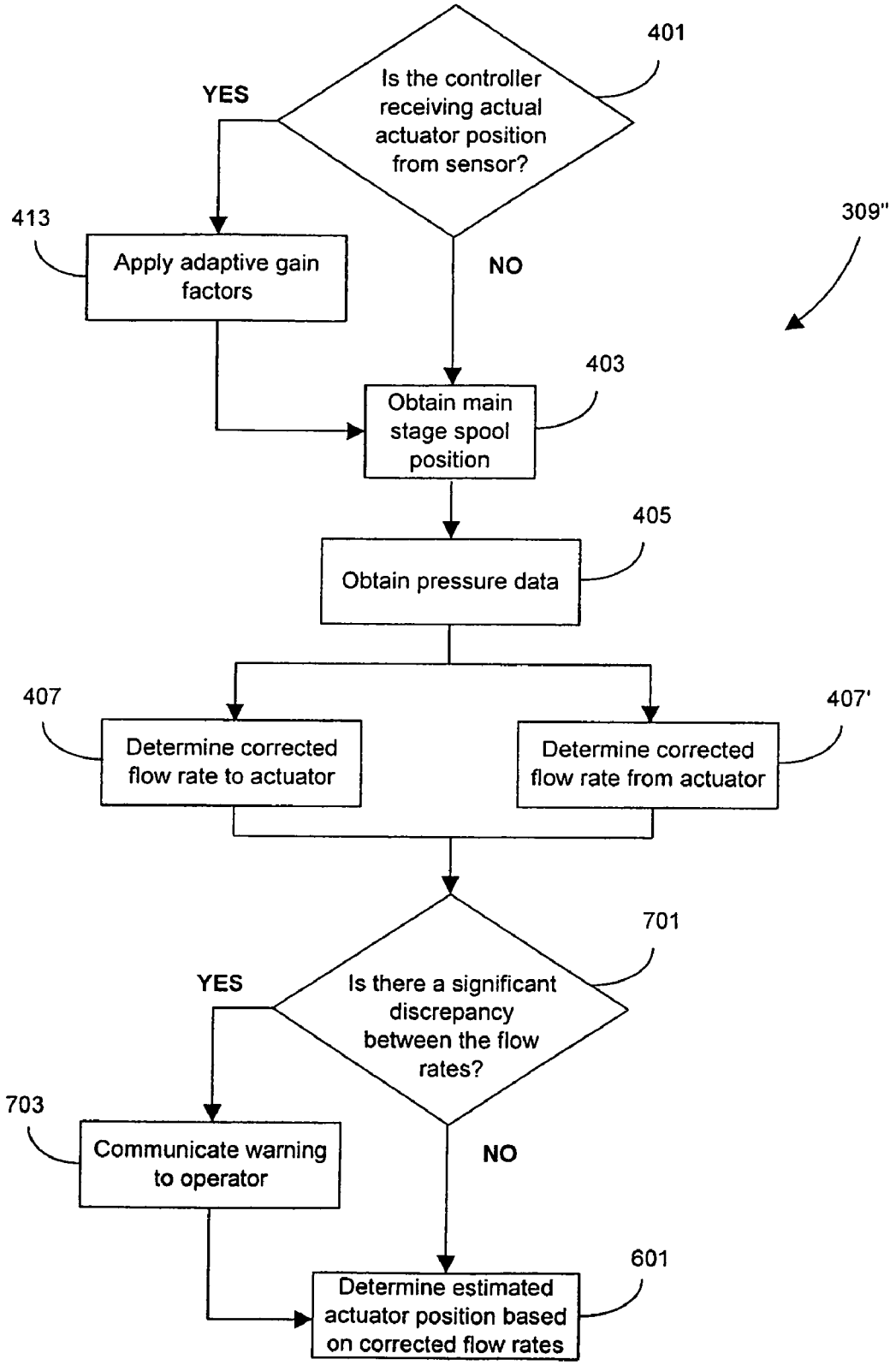
FIG. 7 is a block diagram of an alternate method for estimating the position of an actuator in accordance with the present invention.

Referring now to FIG. 7, an alternate method 309" is illustrated, which provides an additional advantage to using two corrected flow rates, $Q_{1,C}$ and $Q_{2,C}$, in the determination of the estimated actuator position will be described. In the alternative method 309", method steps that are the same or similar as those in methods 309 and 309' will have the same reference number and will not be further described. Additional method steps, however, shall have reference numerals in excess of "700" and shall be described in detail.

In the alternate method 309", a comparison is made between the two corrected flow rates, $Q_{1,C}$ and $Q_{2,C}$, in step 701. If the corrected flow rates, $Q_{1,C}$ and $Q_{2,C}$, are similar in value, the estimated actuator position is determine in step 601. If, however, the corrected flow rates, $Q_{1,C}$ and $Q_{2,C}$, are significantly different, a warning is sent to the operator in step 703. In this way, the corrected flow rates, $Q_{1,C}$ and $Q_{2,C}$, are used as a type of fault detection for the actuator position control system 11. For example, if the corrected flow rate, $Q_{1,C}$, for the first chamber 27 of the cylinder 21 is significantly different than the corrected flow rate, $Q_{2,C}$, for the second chamber 29 of the cylinder 21, a warning is communicated to the operator in step 703 that there may be a problem with the actuator position control system 11. The type of warning is not critical to the scope of the present invention and could include visual or audible warnings. While the significant discrepancy in the corrected flow rates, $Q_{1,C}$ and $Q_{2,C}$, could not isolate the problem to a specific component, such as one of the pressure sensors 31*a*, 31*b*, 31*c*, 31*d* or one of the spool position sensors 33*a*, 33*b*, in the actuator position control system 11, it would notify the operator of a potential problem with the system as a whole. It will be understood by those skilled in the art after reviewing the disclosure of the present invention that placement order of step 701 is not critical to the scope of the present invention.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. An actuator position control system comprising an actuator;

at least one actuator position sensor mounted to the actuator;

a flow control valve having at least one main stage spool, at least one spool position sensor that monitors the position of the main stage spool, a supply port, a tank port, a first control port, and a second control port wherein the flow control valve is in fluid communication with the actuator;

a plurality of fluid pressure sensors for monitoring pressure of fluid at the supply port, the tank port, the first control port, and the second control port of the flow control valve; and a controller being in electrical communication with the flow control valve, wherein the controller is configured to:

receive a desired actuator position input;

receive fluid pressure data signals from the plurality of fluid pressure sensors;

receive spool position signals from the spool position sensor;

receive actuator position data signals from the actuator position sensor;

determine corrected fluid flow rates to and from the actuator based on the fluid pressure data signals, the spool position signals, and an error-correction factor, wherein the error-correction factor is a function of the fluid pressure data signals and the spool position signals;

determine estimated actuator position, wherein the estimated actuator position determination includes a kinematic component, which is a function of the corrected fluid flow rates to and from the actuator, and a dynamic component, which is a function of a pressure of a chamber of the actuator;

apply adaptive gain factors to calibrate the estimated actuator position to the actuator position data signals from the actuator position sensor;

compare the estimated actuator position to the desired actuator position input; and close the main stage spool valve to prevent fluid communication to the actuator.

2. The actuator position control system as claimed in claim 1 wherein the controller is further configured to compare the corrected fluid flow rate to the actuator and the corrected fluid flow rate from the actuator and send a warning signal when there is a significant difference between the corrected fluid flow rates.

3. The actuator position control system as claimed in claim 2 wherein the warning signal is audible.

4. The actuator position control system as claimed in claim 2 wherein the warning signal is visual.

5. The actuator position control system as claimed in claim 1 wherein the actuator is a linear actuator.

6. The actuator position control system as claimed in claim 1 wherein the actuator is a cylinder.

7. The actuator position control system as claimed in claim 1 wherein the actuator position sensor is mounted at a center location on the cylinder.

8. The actuator position control system as claimed in claim 1 wherein the plurality of fluid pressure sensors are disposed in the flow control valve.

9. The actuator position control system as claimed in claim 1 wherein the controller is disposed in the flow control valve.

10. The actuator position control system as claimed in claim 1 wherein the flow control valve includes two main stage spools.

11. The actuator position control system as claimed in claim 10 wherein a pilot stage spool is associated with each main stage spool in the flow control valve.

12. The actuator position control system as claimed in claim 1 wherein the spool position sensor is a Linear Variable Differential Transformer.

13. An actuator position control system as claimed in claim 1 wherein the actuator position sensor is a latch sensor.

14. A method for estimating actuator position comprising the steps of receiving fluid pressure data signals from a plurality of fluid pressure sensors;

receiving spool position signals from at least one spool position sensor;

receiving actuator position data signals from at least one actuator position sensor;

determining corrected fluid flow rates to and from an actuator with each corrected fluid flow rate based on the fluid pressure data signals, the spool position signals, and an error-correction factor, wherein the error-correction factor is a function of the fluid pressure data signals and the spool position signals;

determining an estimated actuator position, wherein the estimated actuator position determination includes a kinematic component, which is a function of the corrected fluid flow rates to and from the actuator, and a dynamic component, which is a function of a pressure of a chamber of the actuator; and applying adaptive gain factors to calibrate the estimated actuator position to the actuator position data signals from the actuator position sensor.

15. The method for determining actuator position as claimed in claim 14 further comprising the step of comparing the corrected fluid flow rate to the actuator and the corrected fluid flow rate from the actuator.

16. The method for determining actuator position as claimed in claim 15 wherein a weighted function is applied to the corrected fluid flow rate to the actuator and the corrected fluid flow rate from the actuator in determining the estimated actuator position.

17. The method for determining actuator position as claimed in claim 15 wherein a warning signal is sent from a controller when there is a significant discrepancy between the corrected fluid flow rate to the actuator and the corrected fluid flow rate from the actuator.

18. The method for determining actuator position as claimed in claim 14 wherein the spool position sensor is a Linear Variable Differential Transformer.

19. The method for determining actuator position as claimed in claim 14 wherein the actuator displacement sensor is a latch sensor.

20. The method for determining actuator position as claimed in claim 14 wherein the actuator is a linear actuator.

21. The method for determining actuator position as claimed in claim 14 wherein the actuator is a cylinder.

* * * * *